United States Patent [19]

Hall, Jr.

[11] 4,114,970

[45] Sep. 19, 1978

[54] ELECTRICAL MARINE CONNECTOR

[75] Inventor: Ernest M. Hall, Jr., Houston, Tex.

[73] Assignee: Western Geophysical Co. of America, Houston, Tex.

[21] Appl. No.: 831,590

[22] Filed: Sep. 8, 1977

[51] Int. Cl.[2] ..... H01R 13/52; H01R 25/02

[52] U.S. Cl. ..... 339/49 R; 339/89 R; 339/94 M

[58] Field of Search ..... 339/89 R, 89 M, 47 R, 339/49 R, 105, 106, 94 M

[56] References Cited

U.S. PATENT DOCUMENTS

| | | | |
|---|---|---|---|
| 2,605,315 | 7/1952 | Hargett | 339/94M X |
| 2,740,098 | 3/1956 | Phillips | 339/89 R X |
| 3,855,566 | 12/1974 | Richardson | 339/89 M X |

FOREIGN PATENT DOCUMENTS

| | | | |
|---|---|---|---|
| 426,978 | 6/1967 | Switzerland | 339/94 M |

*Primary Examiner*—Roy Lake
*Assistant Examiner*—E. F. Desmond
*Attorney, Agent, or Firm*—William A. Knox

[57] ABSTRACT

The marine connector comprises a pair of complementary connector units, each attachable to an electric cable-end for interconnecting the same. Each connector unit has longitudinally-spaced, front and rear end walls interconnected by an axial transverse partition. Male and female electric contact elements are mounted on the front wall of each connector unit on opposite sides of the partition and are aligned for telescopic connection with one another. The conductor ends are anchored to the partition by means including a solder ball and extend therefrom to the related contact elements. A sealing sleeve made of a flexible resilient material is slidably mounted on the cable-end portion leading to each unit. Compression means constructed of rigid material are slidable on the cable ends and have axial bores to slidably receive the sealing sleeves and are adapted to axially compress the sealing sleeves to effect both internal and external expansion thereof to thereby provide fluid-tight seals between the cable and the compression means. A two-part male and female threaded housing is slidably mounted about the respective cable ends for enclosing the joined connector units when the two parts are screwed together and are operable thereby to exert end-wise forces for actuating the compression means.

4 Claims, 9 Drawing Figures

ELECTRICAL MARINE CONNECTOR

BACKGROUND OF THE INVENTION

In geophysical prospecting, especially in marshy and swampy areas, geophone cable spreads are made up in the field by joining electric cable ends with marine connectors. The connector must accomplish the normal function of a connector, that is to interconnect the electric conductors of the cable ends, and in addition the connector must be so constructed as to prevent entrance into the connector of the surrounding fluid in which the connector may be immersed. Also, it is desired that the installation of the connector in the field be possible with minimum of effort and skill required. It is also desired that the imperviousness of the connector should not depend on the skill of the installer since in many areas of the world, such as jungles, skilled labor is frequently lacking. Other desiderata are that the connector should require minimum maintenance, and that no solder lugs, nuts or screws be required for the lead ends of the conductors since the same are easily lost and frequently become corroded in use.

The above and other advantages of the improved marine connector of the invention will become apparent from the following detailed description in connection with present preferred embodiments thereof.

SUMMARY OF THE INVENTION

The marine connector comprises a pair of identical complementary connector units, each attachable to an electric cable-end for interconnecting the same. Each connector unit has longitudinally-spaced, front and rear end walls interconnected by an axial transverse partition wall. Male and female electric contact elements are mounted on the front wall of each connector unit on opposite sides of the partition wall and are aligned for telescopic connection with one another. A pair of spaced-apart openings are provided through the rear wall leading to the opposite sides of the partition wall for receiving the lead ends of a pair of electric conductors projecting from the cable end. A pair of transverse passages through the partition wall allow the conductor ends to extend to the opposite sides of the partition wall. The conductor ends, anchored to the partition wall by means including solder balls greater in transverse dimensions than the diameters of the passages through the partition wall, and electrically connected to the contact elements. A sealing sleeve made of a flexible resilient material is slidably mounted on the cable-end adjacent the rear wall of the connector unit. Compression means constructed of rigid material are slidably mounted on the cable ends. The compression means have axial bores to slidably receive the sealing sleeves and are adapted to axially compress the sealing sleeves to effect both internal and external expansion thereof thereby to provide fluid-tight seals between the cable and the compression means. A two-part male and female threaded housing is slidably mounted about the respective cable ends for enclosing the joined connector units when the two parts are screwed together and are operable thereby to exert end-wise forces for effecting the desired sealing of the housing against entrance therein of fluid in which the connector may be immersed.

DETAILED DESCRIPTION OF A PREFERRED EMBODIMENT

Figure 1:
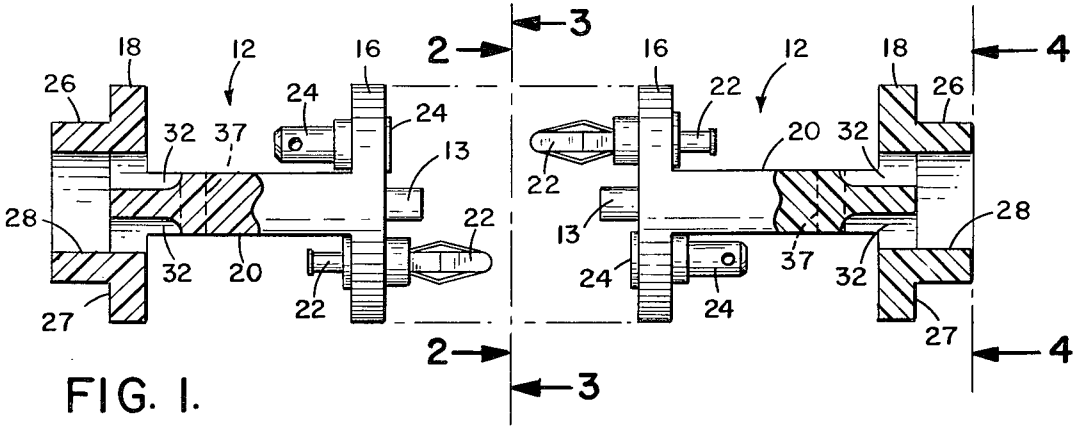
FIG. 1 is a longitudinal view, partly in section, of the two connector units shown in separated relation.
Figure 2:
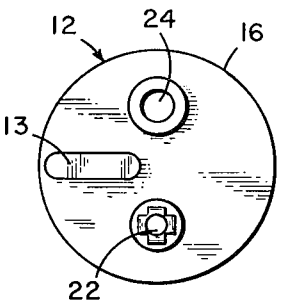
FIGS. 2 and 3 are end views taken on lines 2—2, and 3—3, respectively, of FIG. 1.
Figure 3:
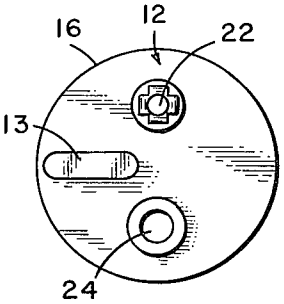
Figure 4:
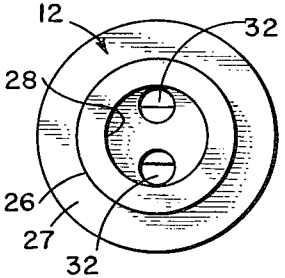
FIG. 4 is an end view taken on line 4—4 of FIG. 1.

Throughout the drawings, the same or similar reference characters are used to designate the same or similar parts to facilitate the understanding thereof.

Figure 6:
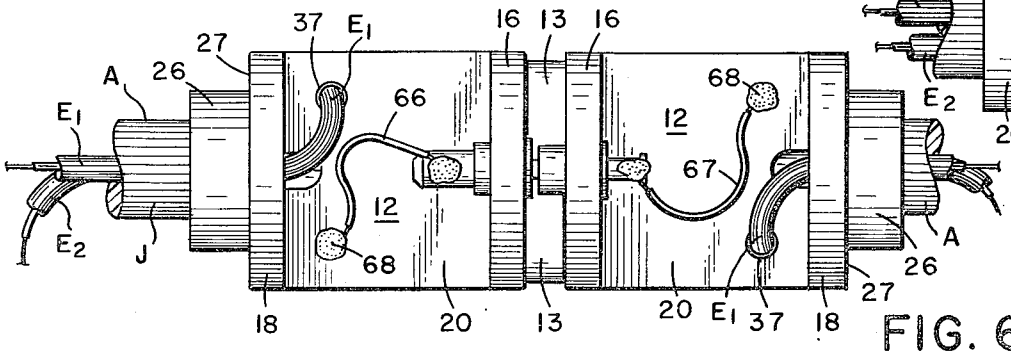
FIG. 6 shows views similar to FIG. 5 but with the connector units interconnected and wired to the cable-ends.
Figure 7:
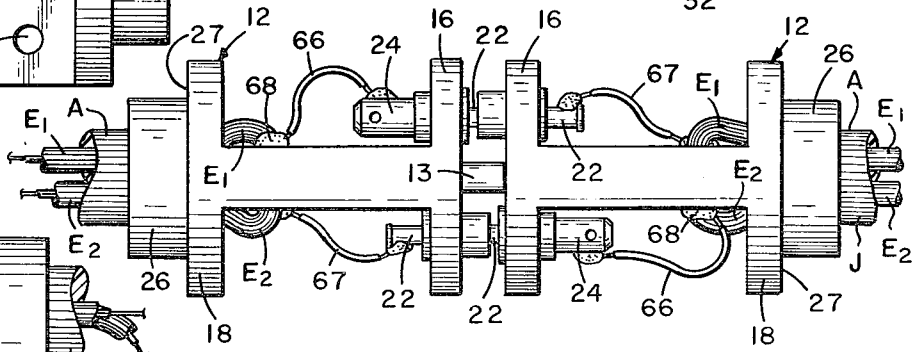
FIG. 7 is a view similar to FIG. 6 with the connector units rotated 90° from their positions shown in FIG. 6.
Figure 8:
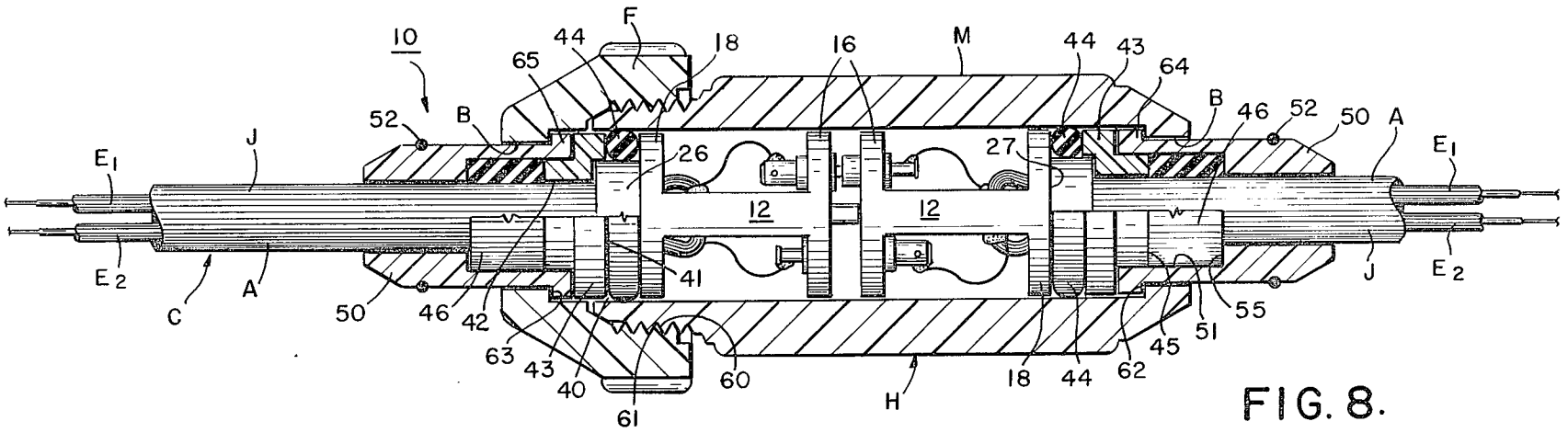
FIG. 8 is a longitudinal, cross-sectional view of the fully assembled marine connector, ready for use.

The marine connector is generally designated as 10 (FIGS. 1 and 8) and includes a pair of identical connector units 12, which are adapted to receive the electric conductors $E_1$-$E_2$ of two cable ends A—A of an electric cable C. Each connector unit 12 is formed of rigid insulating material and has a spool-like structure comprising longitudinally-spaced front and rear circular walls 16, 18, respectively, connected together by an axial transverse partition wall 20. The front circular end wall 16 is provided with a lug 13 forwardly projecting from the front face of the front wall to limit the extent of the axial movements of the connector units toward each other. In this manner the lugs 13 serve as spacers between the front walls 16. Extending through the front wall 16 on the opposite sides of spacer 13 are a pair of electric contacts, a male or prong contact 22 and a female or socket contact 24. The sockets are adapted to telescopically receive the prongs 22 in response to axial end-wise engagement of the connector units with one another (FIGS. 6–7).

The rear wall 18 is provided with a rearwardly-projecting collar 26 smaller in diameter than the rear wall and having an axial bore 28 (FIG. 1) adapted to receive a cable-end A.

Bore 28 communicates with a pair of spaced-apart openings 32—32 which extend through wall 18 to the opposite sides of partition wall 20. The partition wall 20 is provided with a pair of transverse passages 37—37 which are adjacent to the inner ends of openings 32—32. The difference in diameters between collar 26 and the outer circular face of rear wall 18 defines an annular shoulder 27. A compression collar 43 (FIG. 8) is disposed in abutting relation to collar 26 and has a bore 42 therethrough adapted to slidably receive the cable end A.

Figure 9:
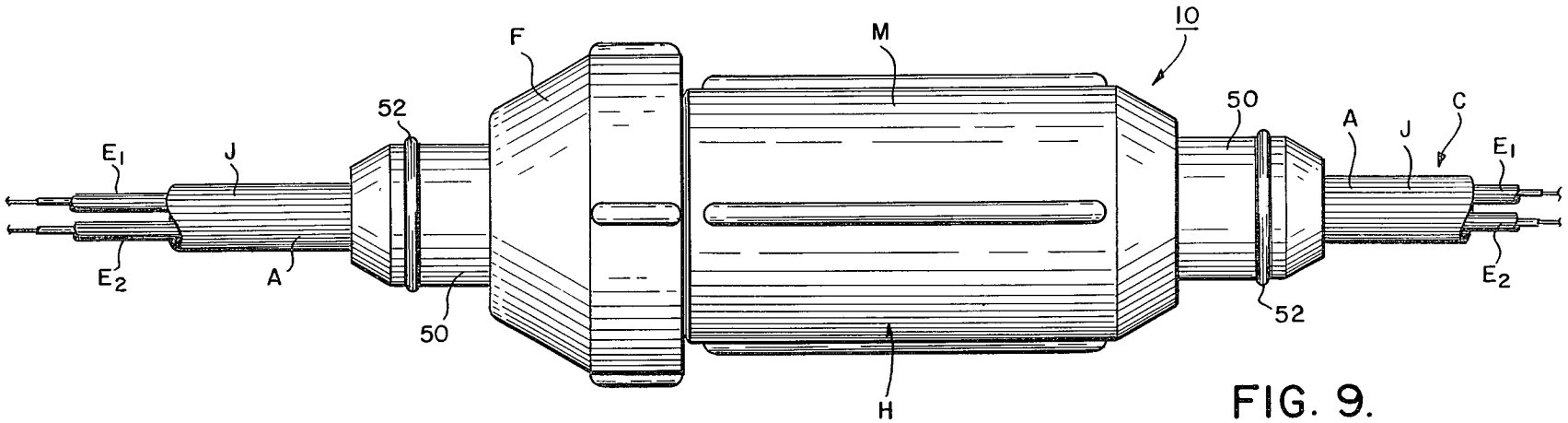
FIG. 9 is an elevational external view of the fully assembled connector.

The compression collar 43 has a forwardly-projecting annular shoulder 41 of substantially the same outer diameter as rear wall 18. The shoulder 41 projects slightly over collar 26 when the compression collar abuts against collar 26, leaving a narrow annular space 40 between the rear wall 18 and the annular shoulder 26 for receiving therein an annular compressible seal ring 44 disposed about the annular collar 26 and abutting shoulder 27. The O-ring 44 is adapted to be compressed by the compression collar 43 when the latter is urged axially toward the rear wall 18 thereby effecting a seal between the shoulder 27 on rear wall 18 and the bore of the connector housing H comprising male and female parts M and F, (FIGS. 8 and 9) respectively, enclosing the connector units 12—12, and having respective axial bores B—B, for receiving the cable ends A—A as will be subsequently described. The rearward end of compression collar 43 defines an annular shoulder 45 smaller in diameter than collar 43.

Slidably mounted on the cable-end A is a sealing sleeve 46 constructed of a flexible resilient material and adapted to be disposed in end-abutting relation to shoulder 45 of compression collar 43. A tubular compression sleeve 50 constructed of a rigid material and having an internal annular shoulder 55 is slidably mounted on the cable-end A and defines an axial chamber 51 adapted to receive therein the sealing sleeve 46 in abutting-compressive relation between annular shoulder 45 and internal shoulder 55.

An O-ring 52 is mounted on the outer cylindrical wall of compression sleeve 50 near the outer end thereof and protrudes slightly from the outer cylindrical surface thereof for the purpose of frictionally engaging the walls of bores B—B thereby to limit the displacement of the housing parts on their respective compression sleeves 50. The frictional engagement is such as to allow separation of the compression sleeve from its housing part as the cylindrical wall of its inlet bore B slides over the O-ring 52.

The housing H is constructed of a rigid material, preferably plastic, and its male part M is generally cylindrical. The female part F of the housing has a threaded bore 60 to threadedly receive the forward end of the male part M which is correspondingly threaded at 61. The torque exerted between the housing parts, when engaged and made-up, produces axial forces urging the telescoping engagement between the male and female contact elements 22, 24. The male and female housing parts define internal annular shoulders 62 and 63, respectively, which are adapted to engage external annular shoulders 64 and 65, respectively, on the inner ends of the compression sleeves 50 when the housing parts are tightly screwed together.

Each pair of insulated electric conductors $E_1$ and $E_2$ is surrounded by an insulating jacket J which is stripped so that its end face abuts as closely as possible against collar 26. In this manner the bore of the compression sleeve 50 slidably receives sealing sleeve 46 and the insulating outer jacket of the cable and ensures the proper sealing engagement between the cylindrical wall of the bore of compression sleeve 50 and the external wall of the cable jacket as a result of the end-wise compression on sealing sleeve 46 between shoulders 45 and 55.

Figure 5:
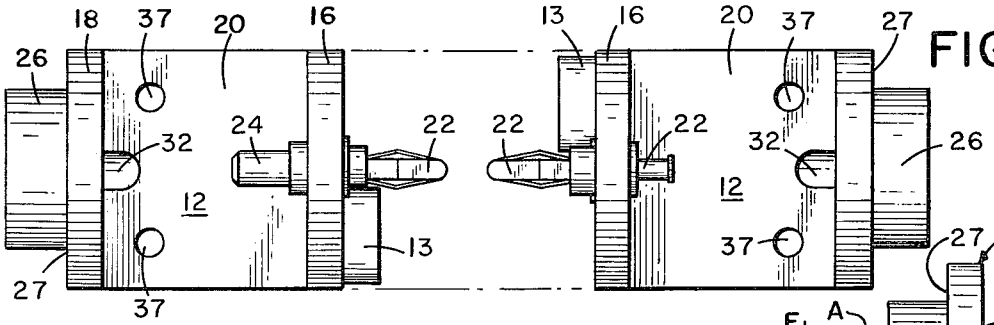
FIG. 5 shows views similar to those shown in FIG. 1 but with the connector units turned 90° from the views shown in FIG. 1.

The insulated conductors of each cable-end pass through the spaced passages 32—32 in rear wall 18 and thence through spaced passages 37—37 in the partition wall 20 (FIGS. 5, 6, and 7). The stripped ends of the conductors are then connected to short conductors 66–67 by suitable means including solder balls 68, each having a transverse dimension larger than the respective passage 37. Conductors 66–67 connect the respective cable conductors $E_1$ and $E_2$ to the prong and socket contact elements 22 and 24. Each lead end of each conductor $E_1$ and $E_2$ is properly anchored by means of the solder ball 68 to the opposite face of the partition wall to prevent the lead end from being pulled out by an excessive pull on the cable-ends away from the connector.

After the lead ends of the conductors $E_1$, $E_2$ are electrically connected as above described, the mating male and female contact elements are telescoped into each other in response to an axial end wise engagement of the connector units with one another. Then the male and female housing parts are screwed into each other and tightened so as to cause the sealing sleeves 46 to become compressed thereby to effect both internal and external expansion thereof. Such sleeve expansion provides a fluid-tight seal between the jacket of the cable and the compression sleeve thereby precluding water from entering into the inlet bore of the compression collar. The end-wise compression is also exerted on the annular shoulder of the compression collar causing the later to establish an effective seal by means of the O-ring 44 between the compression collar and the bores of the housing parts thereby precluding water which may enter through the openings B—B of the housing parts from penetrating into the connector units and corroding or shorting-out the electric contact elements.

It will therefore be appreciated that this invention provides an easy to assemble marine connector which provides proper anchoring for the electric conductors of the cable ends and effective sealing for the lead ends of the conductors as well as the electric contacts connected thereto.

I claim:

1. An electrical cable connector, comprising:

a. a pair of connector units each attachable to a cable-end for electrically interconnecting the same;

b. each connector unit formed of rigid insulating material defined by longitudinally-spaced front and rear circular end walls connected by an axial transverse partition wall;

c. male and female electrical contact elements mounted on the front end wall of each connector unit on opposite sides of said partition wall and being aligned for telescopic connection with one another in response to axial endwise movement of said units toward each other;

d. an axial opening in said rear end wall to receive a cable-end and communicating with a pair of spaced-apart openings leading to opposite sides of said partition wall;

e. passages extending transversely through said partition wall in spaced relation to said spaced apart openings for separately receiving the lead ends of electrical conductors projecting from said cable-end extending through said spaced-apart openings and said passages to said opposite sides of said partition wall; and f. means electrically connecting said lead ends to the related contact elements including solder balls each greater in transverse dimension than its related passage for anchoring said lead ends to said partition wall.

2. A connector according to claim 1 including spacer elements mounted on said front walls to limit the extent of said endwise movements of said units toward each other.

3. An electrical cable connector, comprising:

a. a pair of identical connector units each attachable to a cable-end for electrically connecting the same;

b. each connector unit formed of rigid insulating material defined by longitudinally-spaced front and rear circular end walls connected together by an axial transverse partition wall;

c. male and female electrical contact elements mounted on the front wall of each connector unit on opposite sides of its partition wall and aligned for telescopic connection with one another in response to axial endwise movement of said connector units toward each other;

d. a collar extending rearwardly from the outer face of each rear end wall smaller in diameter than the latter and having an axial opening to receive a cable end, said collar defining on said outer face of said rear end wall a first annular shoulder;

e. an annular compressible seal ring disposed about said first annular shoulder;

f. a compression collar slidably mounted about the cable end for abutting engagement with said seal ring;

g. spaced-apart openings through said rear wall leading from said axial opening in said collar to opposite sides of said partition wall for receiving the lead ends of a pair of electrical conductors projecting from said cable end;

h. a pair of transverse passages through said partition wall for extending said conductor ends to the opposite sides of said partition wall;

i. means including anchoring means connecting said conductor ends to the related contact elements and anchoring the conductor ends to said partition wall;

j. a second annular shoulder defined by the rearward face of said compression collar and smaller in diameter than the latter;

k. a sealing sleeve of flexible resilient material slidably mounted about the cable in end-abutting relation to said second annular shoulder;

l. a compression sleeve of rigid material slidable on the cable end and having an axial bore to slidably receive said sealing sleeve and having an internal shoulder adapted to compress said sealing sleeve against said second shoulder in response to endwise force exerted on said compression sleeve thereby to effect both internal and external expansion of said sealing sleeve, said expansion providing fluid-tight seals between the cable and said second shoulder on one hand, and between the cable and the wall of said axial bore in said compression sleeve on the other hand; and m. a two-part male and female threaded housing having cable-receiving openings slidably mounted about the respective cable-ends for enclosing the joined connector units when the housing parts are screwed together and operable thereby to exert said end-wise force and for sealing said housing against entrance therein of fluid in which said connector may be immersed.

4. A connector according to claim 3 wherein said compression sleeve is formed about its forward end with an external shoulder greater in diameter than its cable-receiving opening, and said external shoulder exerting pressure on said compression collar.

* * * * *